US005332147A

United States Patent [19]

Sorenson

[11] Patent Number: 5,332,147

[45] Date of Patent: Jul. 26, 1994

[54] BUCKLE-PROOF CLAMSHELL CARTON

[75] Inventor: John F. Sorenson, Naperville, Ill.

[73] Assignee: Perseco Division Of The Havi Group LP, Oak Brook, Ill.

[21] Appl. No.: 51,533

[22] Filed: Apr. 23, 1993

Related U.S. Application Data

[63] Continuation-in-part of Ser. No. 898,026, Jun. 12, 1992, Pat. No. 5,221,040.

[51] Int. Cl.[5] ..... B65D 5/66

[52] U.S. Cl. ..... 229/114; 229/146; 229/148; 229/906; 229/920

[58] Field of Search ..... 229/114, 146, 148, 149, 229/150, 902, 906, 920; 220/4.23, 4.24, 4.25

[56] References Cited

U.S. PATENT DOCUMENTS

| | | |
|---|---|---|
| 329,134 | 10/1885 | Brotz . |
| 708,289 | 9/1902 | Winslow . |
| 1,329,531 | 2/1920 | Kitt . |
| 1,771,760 | 7/1930 | MacLellan . |
| 1,839,752 | 1/1932 | Fogg . |
| 2,247,870 | 7/1941 | Chalmers . |
| 2,468,543 | 4/1949 | Chalmers . |
| 2,544,565 | 3/1951 | Phillips . |
| 3,135,456 | 6/1964 | Palazzolo . |
| 3,163,344 | 12/1964 | Tunick . |
| 3,190,535 | 6/1965 | Nute . |
| 3,228,710 | 1/1966 | Chodorowski . |
| 3,330,467 | 7/1967 | Johnson . |
| 3,343,660 | 9/1967 | Bailey . |
| 4,230,261 | 10/1980 | Austin . |
| 4,232,816 | 11/1980 | Johnson et al. . |
| 4,245,773 | 1/1981 | Stollberg . |
| 4,254,862 | 3/1981 | Barratt . |
| 4,266,713 | 5/1981 | Maroszek . |
| 4,304,353 | 12/1981 | Stollberg . |
| 4,360,147 | 11/1982 | Brauner . |
| 4,389,013 | 6/1983 | Hall et al. . |
| 4,413,726 | 11/1983 | Davidson . |
| 4,431,128 | 2/1984 | Dirico . |
| 4,570,845 | 2/1986 | Hall . |
| 4,792,085 | 12/1988 | Waring, III et al. . |
| 4,877,178 | 10/1989 | Eisman . |
| 4,909,432 | 3/1990 | Nagata . |
| 5,039,003 | 8/1991 | Gordon et al. . |
| 5,098,013 | 3/1992 | France et al. . |
| 5,205,476 | 4/1993 | Sorenson . |
| 5,221,040 | 6/1993 | Sorenson . |

FOREIGN PATENT DOCUMENTS

| | | |
|---|---|---|
| 2441037 | 6/1975 | Fed. Rep. of Germany . |
| 2703432 | 8/1977 | Fed. Rep. of Germany . |
| 92/09486 | 6/1992 | World Int. Prop. O. . |

*Primary Examiner*—Gary E. Elkins
*Attorney, Agent, or Firm*—Willian Brinks Hofer Gilson & Lione

[57] ABSTRACT

A clamshell type carton is provided with a cut along the hinge score line connecting the upper cover and lower tray portions. A second cut is placed in the back panel of the carton, above or below the hinge score line cut, wherein the second cut is a continuous curve having a first end point located in the back panel and a second end point intersecting the cut along the hinge score line. The second cut is utilized to facilitate the easy opening and closing of the carton without buckling occurring in the back panel in the region of the hinge score line.

54 Claims, 3 Drawing Sheets

Fig. 1
Prior Art
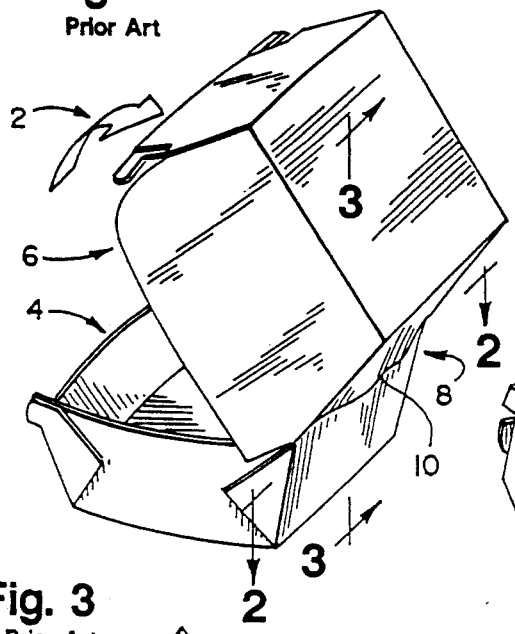
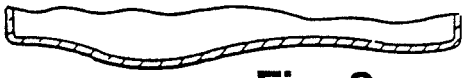
Fig. 2
Prior Art
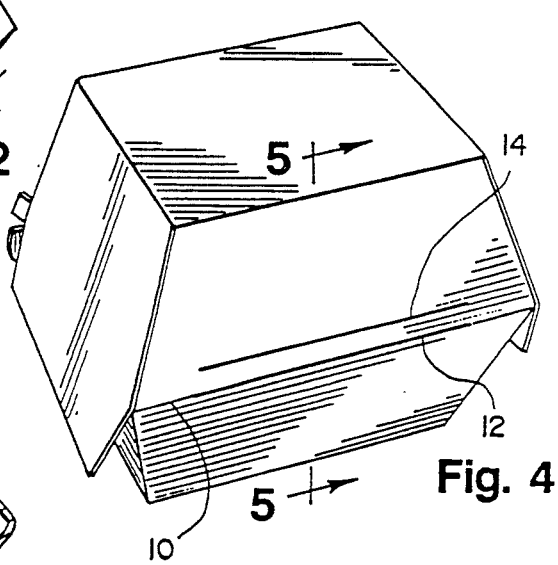
Fig. 4
Fig. 3
Prior Art
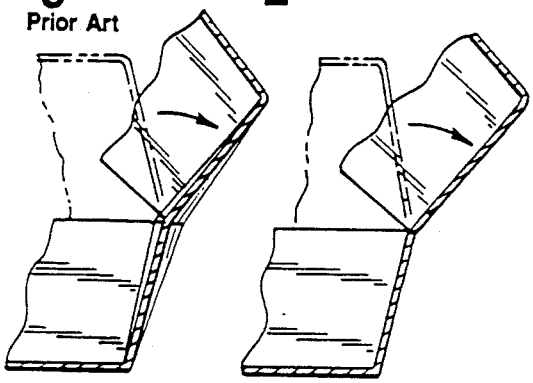
Fig. 5
Fig. 6
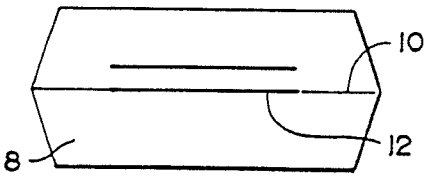
Fig. 7
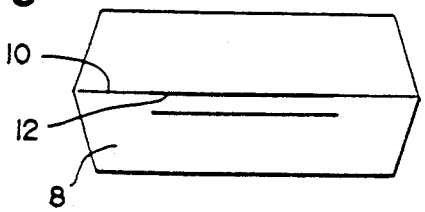
Fig. 8
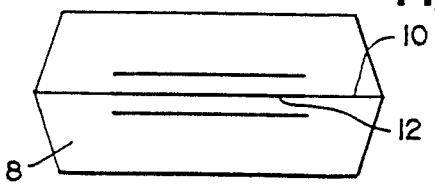
Fig. 9
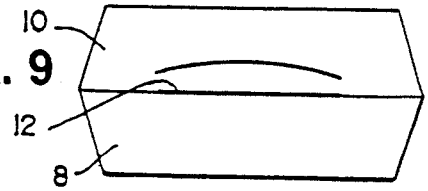
Fig. 10
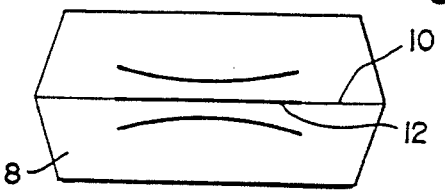

Fig. 11
Prior Art
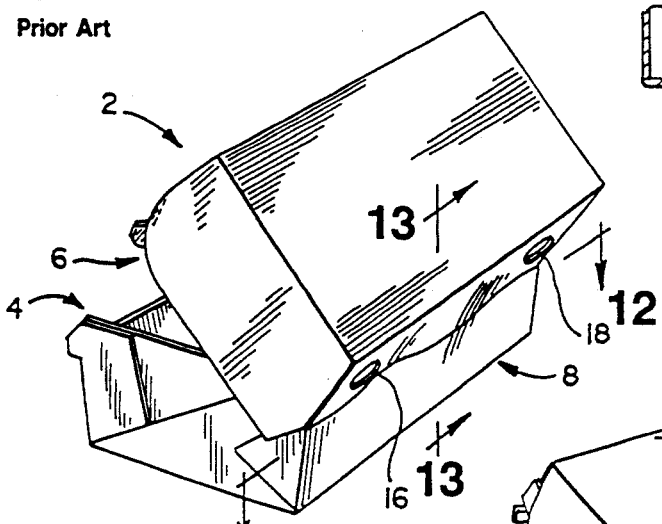
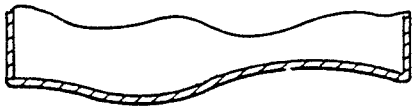
Fig. 12
Prior Art
Fig. 14
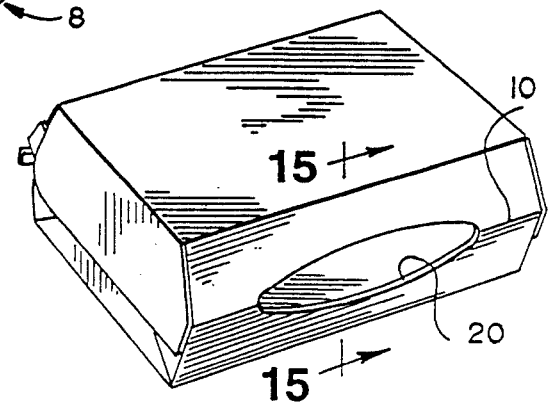
Fig. 13
Prior Art
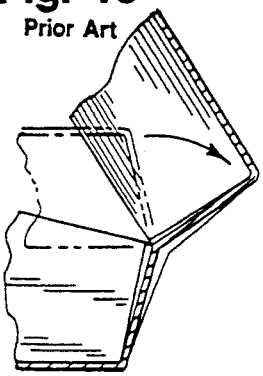
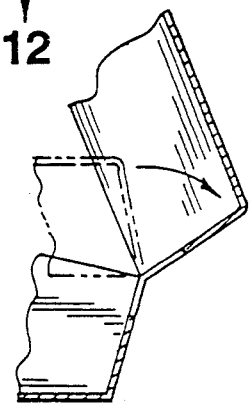
Fig. 15
Fig. 16
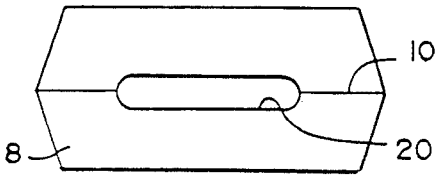
Fig. 17
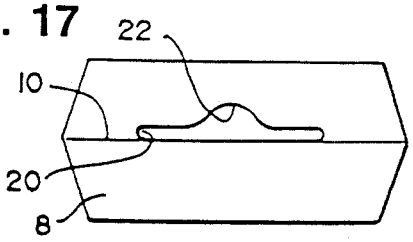
Fig. 18
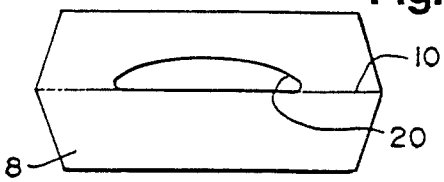
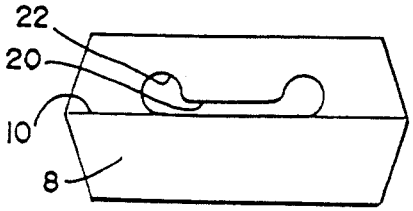
Fig. 19
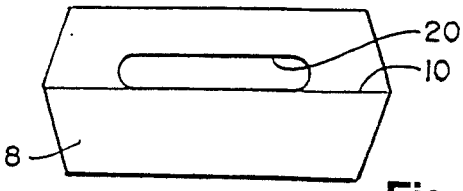
Fig. 20

BUCKLE-PROOF CLAMSHELL CARTON

This application is a continuation-in-part of application Ser. No. 07/898026 filed Jun. 12, 1992 and now U.S. Pat. No. 5,221,040 issued Jun. 22, 1993.

FIELD OF THE INVENTION

This invention generally relates to double cavity "clamshell" containers such as those used in the packaging of hamburgers and other food products. More specifically, the invention concerns clamshell cartons fabricated from folded paperboard, boxboard or corrugated board, and addresses the problem of buckling which occurs in the center back region of such cartons upon opening and closing.

BACKGROUND OF THE INVENTION

In fast service and carry-out food businesses, it is necessary to package food products in containers which are inexpensive, easy to ship and store, and convenient to use for the retailer and the consumer. When assembled and filled with food products, such containers must be easy to close and open, and yet they must remain shut in transport from the food counter to a table or other carry out location. It is also important, in the design and construction of such containers, to take into account environmental aspects of their use.

One form of packaging which has addressed these concerns, and has met with acceptance, is a carton comprised of a joined tray and cover with integral latching means which can be readily formed from a cut and scored blank. The cut and scored blank is made from paperboard, boxboard or corrugated board. When partially folded and glued, the blank forms a hingedly connected tray and cover, each in the form of a truncated pyramid. Such partially folded cartons can be shipped and stored in nested condition. In use, various food products, such as hamburgers, chicken pieces, pizza slices and the like, are placed in the tray portion of the partially folded carton, and the cover portion is folded over the tray portion and latched thereto at a location opposite the fold or hinge in the back panel of the carton. Such double cavity, folded tray and cover, cartons are referred to a clamshell cartons. A clamshell carton is disclosed, for example, in U.S. Pat. No. 4,877,178, issued Oct. 31, 1989 to Dopaco, Inc. as assignee.

One problem which has been encountered with such clamshell cartons, particularly when they are made from thinner grades of paperboard, has been their tendency to buckle in the back as they are being closed by restaurant crew persons or opened by customers. For example, when the top cover portion is lifted and folded back on the center hinge in the rear portion of the carton, the region adjacent the hinge tends to flex and bow. This problem is sometimes referred to as "oil canning" because the back region of the carton can distort as opening begins and then pop back into its proper and intended configuration, in much the same way as an oil can lid pops back into position after being depressed. The buckling problem appears to be caused by the flexible nature of the carton material, the spacing between the front of the carton and the back region where the buckling occurs and the forces applied to the carton portions as they are handled during the closing and opening operations. This problem is a troublesome and awkward one for crew persons trying to rapidly assemble and fill nested and partially folded blanks, and for consumers trying to open the carton and access its contents. Sometimes, a consumer can alleviate the problem during opening by pressing his fingers in the buckled region to realign the carton portions. In other instances, however, trying to fully open the cover and forcibly overcome the buckling can result in a torn container and/or spilled contents.

The prior art has addressed this buckling problem. U.S. Pat. No. 4,232,816 discloses the use of one or more slits which are normal to, and bisect, the fold line in the rear wall of a clamshell container. Such slits are said to weaken the center portion of the rear wall and thereby reduce the tendency of that wall to buckle upon opening. U.S. Pat. No. 4,266,713 discloses the provision of lines of weakness so positioned relative to the center hinge as to create a separate hinge ridge or an inverted hinge channel upon closing the carton. Such a hinge ridge or hinge channel is said to stabilize the rear carton wall against buckling and/or bowing outwardly. U.S. Pat. No. 4,792,085 discloses various diagonal, intersecting incisions above and below the hinge line of a clamshell container, as well as ribs formed above, below and parallel to the hinge line.

These efforts of the prior art, while directed at the buckling problem associated with clamshell cartons, have not been widely accepted; and have been found to be less than entirely satisfactory.

Accordingly, it is a primary object of this invention to provide a novel clamshell carton construction which can be easily made and conveniently closed or opened without encountering undesirable buckling or "oil canning" effects.

SUMMARY OF THE INVENTION

The above and other objects are realized in the clamshell carton of the present invention, wherein a knife cut is made along the hinge line or hinge score of the blank used to fabricate the clamshell carton. At the same time, a second knife cut is made adjacent the first knife cut in the back panel of the carton. The second knife cut is located either above or below the hinge line. Furthermore, the second cut is a continuous curve having a first end point located in the back panel and a second end point coextensive with the first cut. The second knife cut working in conjunction with the first knife cut along the hinge line have proven to lessen the aforediscussed buckling problem found in prior art clamshell containers.

As long as one knife cut lies along the hinge score line, the placement and shape of the second knife cut is not critical, and there can be many alternative arrangements within the scope of the present invention. For example, the second cut can be curved or zigzagged. The second cut can be partially parallel to the first cut. The second cut can be spaced at varying distances from the cut along the hinge line. The first and second cuts can have differing lengths. Combinations of such features may likewise be employed within the teachings and scope of the present invention.

In accordance with the present invention, a stress relief region is created by the adjacent knife cuts or the slot which virtually eliminates oil canning. The full nature of the invention will be understood from the accompanying drawings and the following description and claims.

BRIEF DESCRIPTION OF THE DRAWINGS

FIG. 1 is a perspective view of a prior art clamshell type carton, and shows buckling in the back panel upon opening.

FIG. 2 is a cross-sectional view taken along line 2—2 of FIG. 1.

FIG. 3 is a cross-sectional view taken along line 3—3 of FIG. 1

FIG. 4 is a perspective view of an improved clamshell type carton, made according to the present invention, and featuring parallel knife cuts in the back panel, one on the hinge score line.

FIG. 5 is a cross-sectional view taken along line 5—5 of FIG. 4.

FIG. 6 is a rear elevation view of the improved clamshell type carton shown in FIG. 4.

FIGS. 7–10 are views of the back panel of the improved clamshell type carton, made according to the present invention, showing other arrangements of cuts which contribute to buckle free opening.

FIG. 11 is a perspective view of a vented prior art clamshell type carton, and shows buckling in the back panel upon opening.

FIG. 12 is a cross-sectional view taken along line 12–12 of FIG. 11.

FIG. 13 is a cross-sectional view taken along line 13–13 of FIG. 11.

FIG. 14 is a perspective view of an improved, vented clamshell type carton, made according to the present invention, and featuring a slot cut out of the back panel and interrupting the hinge score line.

FIG. 15 is a cross-sectional view taken along line 15—15 of FIG. 14.

FIGS. 16–24 are views of the back panel of the improved clamshell type carton, made according to the present invention, showing other configurations which contribute to buckle free opening and closing.

DETAILED DESCRIPTION OF THE PREFERRED EMBODIMENT

Figure 21:
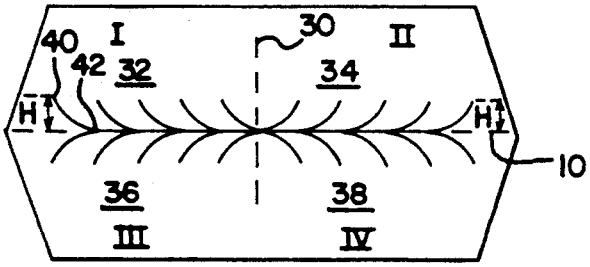

Reference is made to FIG. 1 for the general details of a typical prior art clamshell type carton used for sandwiches and the like. There is shown a carton which is assembled from a unitary cut and scored blank. In its assembled form, the carton 2 has a hingedly connected tray 4 and cover 6, each in the form of a truncated pyramid, joined by an integral back panel 8. In use, food product is placed in tray 4 and the cover 6 is folded over the tray 6 and latched thereto at the forward end of the carton. FIG. 1 also shows the hinged connection of the tray 4 and cover 6 defined by the scored hinge line 10 extending horizontally across the center of back panel 8. The scored hinge line 10 may be formed by a crease, a perforation or a combination thereof; however, it must be sufficiently strong so as to permit repeated opening and closing and to maintain the structural integrity of the container.

The particular latching mechanism illustrated in FIG. 1 is not a part of the present invention or the prior art; rather, such latching mechanism is disclosed and claimed in commonly owned and pending application Ser. No. 07/898,027, filed Jun. 12, 1992, the disclosure of which is incorporated herein by reference.

As will be seen in FIGS. 1–3, the prior art clamshell type carton of FIG. 1 is prone to buckling in the back panel 8 when the cover 6 is lifted and folded back on the center hinge in the back panel 8. It should be noted that the buckling problem is an equally troublesome one during the carton closing operation.

FIG. 4 shows an improved clamshell type carton according to the present invention. The parts of the illustrated carton perform similar functions to the parts shown in the carton of FIG. 1, and are identified with like numbers. Unlike the prior art, however, the improved clamshell container of the present invention has a cut 12 along a portion of the scored hinge line 10 and an adjacent cut 14 in the back panel 8 above cut 12. In practice, it has been found advantageous to place the cut 12 generally in the vicinity of the midpoint of hinge line 10 as it runs from one side of the container 2 to the other. Such placement enables the use of a cut 12 which is as long as possible without severing or destroying the integrity of hinge line 10. Generally, it has been found suitable to make cut 12 a length equal to approximately half the length of the hinge line 10. As illustrated in FIG. 4, cut 14 is parallel to and coextensive with cut 12. Also, they are adjacent, meaning that they may be closely spaced apart from each other. It has been found expeditious to space cuts 12 and 14 approximately ¼-inch apart.

Alternative versions of cooperating cuts are shown in FIGS. 6–10. FIG. 6 and FIGS. 7–10 show the use of cartons having perforated hinge lines. FIG. 7 further shows placement of the second cut at a location on back panel 8 which is below hinge line 10. FIG. 8 shows that cuts can be made above and below the hinge line, so long as there exists a cut along the hinge line. FIGS. 9–10 show that the cut or cuts corresponding to the hinge line cut may be curved. Furthermore, it is within the teachings and scope of this invention that the respective cuts can be of different lengths, sizes and shapes so long as at least one knife cut lies along the hinge score line.

FIGS. 11–13 are illustrative of prior art clamshell type containers used in applications where it is desirable to provide an opening in the container to vent the contents. Thus, FIG. 11 shows a carton construction similar to that shown in FIG. 1, but more rectangular and having vent holes 16 and 18 in the back panel. Prior art vented cartons such as the one shown in FIGS. 11–13 experience the same buckling or oil canning phenomenon in use.

FIG. 14 shows a buckle-proof clamshell type carton made, according to the present invention, for applications where venting of the carton contents is desirable or required. A generally elliptical, horizontal slot 20 is cut out of back panel 8 at a location which interrupts hinge line 10. As shown in FIGS. 16–20, the slot 20 can be cut to a number of different shapes and sizes. However, the slot must always break or interrupt the hinge line 10 on the back panel 8. Depending on the size of the slot, and the equipment used to strip excess paper material away from the cut and scored blank used to make the carton, it may be necessary to configure the slot with a protuberance or enlargement that the stripper barbs can engage during a stripping operation. One or more such enlarged portions 22 may be employed, as shown in FIGS. 17 and 19.

In FIG. 21, an embodiment of the present invention is shown. As with the embodiment of FIG. 4, a continuous cut 12 is positioned along a portion of the scored hinge line 10. Cut 12 generally is centrally located with respect to the hinge line 10 as it runs from one side of the container 2 to the other. Such placement enables the use of a cut 12 which is as long as possible without severing or destroying the integrity of hinge line 10. Generally, it has been found suitable to make cut 12 a length equal to approximately one half the length of the hinge line 10.

Located on both sides of the cut 12 are a plurality of cuts 32, 34, 36, and 38. Hinge line 10 and line 30, which bisects and is perpendicular to hinge line 10, define four quadrants I, II, III, and IV at which cuts 32, 34, 36, and 38 are respectively located. Cuts 32 are continuous curves having a first end point 40 located in the back panel and a second end point 42 which intersects or is adjacent to the cut 12. Cuts 32 have a height H of approximately ¼" and a radius of curvature of approximately ⅝" R. Cuts 32 have a negative slope throughout their length from the first end point to the second end point. Located in quadrant II are a plurality of cuts 34 which are mirror images of cuts 32 with respect to line 30. Furthermore, there may be cuts 32 and 34 in which their second end points 42 intersect each other at line 30. In the case of the cuts 32 and 34 not intersecting each other at line 30, those cuts 32 and 34 nearest line 30 are separated from each other by approximately ¼". Cuts 32 are evenly spaced from each other by approximately ½". Likewise, cuts 34 are evenly spaced from each other by approximately ½".

Cuts 36 are located in quadrant III and are below the hinge line 10. Cuts 36 are evenly spaced from each other by approximately ½" and are mirror images of cuts 32 with respect to the hinge line 10. Similarly, cuts 38 located in quadrant IV are evenly spaced from each other by approximately ½" and are mirror images of cuts 34 with respect to hinge line 10. As with cuts 32 and 34, there may be cuts 36 and 38 in which their second end points 42 intersect each other at line 30.

Figure 22:
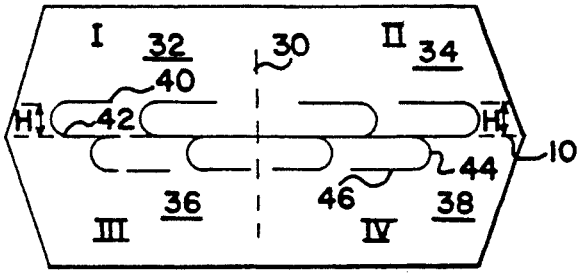
Figure 23:
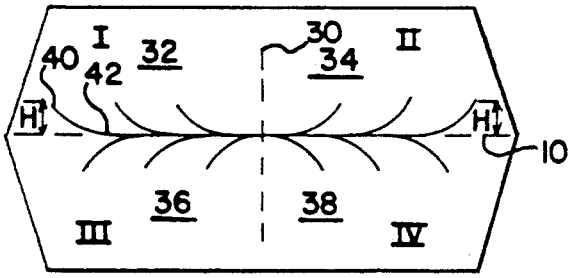

Two other embodiments of the present invention are shown in FIGS. 22 and 23. As with the embodiment of FIG. 21, a continuous cut 12 is positioned along a portion of the scored hinge line 10. Cut 12 generally is centrally located with respect to the hinge line 10 as it runs from one side of the container 2 to the other. In the embodiment of FIG. 22, cut 12 has a length equal to approximately eight tenths of the length of the hinge line 10. In the embodiment of FIG. 23, cut 12 has a length equal to approximately one half of the length of the hinge line 10. Located on both sides of the cut 12 are a plurality of cuts 32, 34, 36, and 38. Cuts 32 are continuous curves having a first end point 40 located in the back panel and a second end point 42 which intersects or is adjacent to the cut 12.

In the embodiment of FIG. 22, cuts 32 are J-shaped having a curved section 44 and a straight section 46. Straight section 46 has a length of approximately ½" and is parallel to the hinge line 12. Cuts 32 have a height H of approximately ¼" and curved section 44 has a radius of curvature of approximately ⅛" R. Located in quadrant II are a plurality of cuts 34 which are mirror images of cuts 32 with respect to line 30. Cuts 32 are spaced from each other by approximately ⅞". Likewise, cuts 34 are spaced from each other by approximately ⅞". Cuts 32 and 34 nearest line 30 are separated from each other by approximately 1 ½".

In the embodiment of FIG. 22, cuts 36 are located in quadrant III and are below the hinge line 10. Cuts 36 are J-shaped in a manner similar to that described with cuts 32. However, cuts 36 are offset with respect to cuts 32 and are spaced from cuts 32 approximately between two adjacent cuts 32. Cuts 36 are spaced from each other by approximately ⅞". Cuts 38 located in quadrant IV are mirror images of cuts 36 with respect to line 30. Cuts 36 and 38 nearest line 30 are separated from each other by approximately ⅞".

In the embodiment of FIG. 23, cuts 32 are continuous having a first end point 40 and a second end point 42 which intersects or is adjacent to cut 12. Cuts 32 have a height H of approximately ¼" and a radius of curvature of approximately ⅝" R. Cuts 32 have a negative slope throughout their length from the first end point to the second end point. Located in quadrant II are a plurality of cuts 34 which are mirror images of cuts 32 with respect to line 30. However, there are no cuts 32 and 34, in which their second end points 42 intersect each other at line 30. Cuts 32 are evenly spaced from each other by approximately ½". Likewise, cuts 34 are evenly spaced from each other by approximately ½". Cuts 32 and 34 nearest line 30 are separated from each other by approximately ⅝".

Cuts 36 are located in quadrant III and are below the hinge line 10. Cuts 36 have the same magnitude for their height and radius of curvatures as cuts 32. Cuts 36 are evenly spaced from each other by approximately ½" and are offset with respect to cuts 32. Cuts 36 have their second end points 42 located approximately halfway between the second end points 42 of adjacent cuts 32. Cuts 38 located in quadrant IV are evenly spaced from each other by approximately ½" and are mirror images of cuts 36 with respect to line 30. As with cuts 32 and 34, there are no cuts 36 and 38 in which their second end points 42 intersect each other at line 30. Cuts 36 and 38 nearest line 30 are separated from each other by approximately 3/16".

Figure 24:
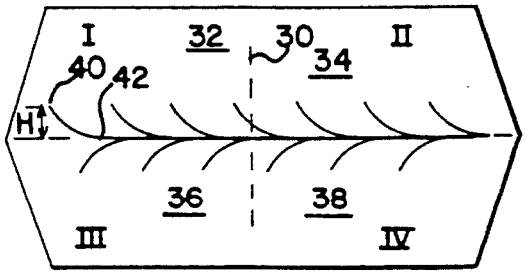

In the embodiment of FIG. 24, cuts 32 are continuous having a first end point 40 and a second end point 42 which intersects or is adjacent to cut 12. Cut 12 has a length equal to approximately seven tenths of the length of the hinge line 10. Cuts 32 have a height H of approximately ¼" and a radius of curvature of approximately ⅝" R. Cuts 32 have a negative slope throughout their length from the first end point to the second end point. Cuts 32 are evenly spaced from each other by approximately ½". Located in quadrant II are a plurality of cuts 34 which have the same shape and spacing as cuts 32. The second end points 42 of cuts 32 and 34 nearest line 30 are each separated from line 30 by approximately 3/16".

Cuts 36 are located in quadrant III and are below the hinge line 10. Cuts 36 have the same magnitude for their height and radius of curvatures as cuts 32. Cuts 36 are evenly spaced from each other by approximately ½" and are offset with respect cuts 32. Cuts 36 have their second end points 42 located halfway between the second end points 42 of adjacent cuts 32. Located in quadrant IV are a plurality of cuts 38 which have the same shape and spacing as cuts 36. The second end points 42 of cuts 36 and 38 nearest line 30 are each separated from line 30 by approximately 3/16". It should be noted that if the pattern of cuts in quadrants I and III of FIG. 23 were continued into quadrants II and IV of FIG. 23, then the embodiment of FIG. 24 would be a substantial result thereof.

Although the invention has been described above by reference to preferred embodiments thereof, it will be appreciated that the foregoing and other changes may be made without departing from the scope and spirit of the invention as defined by the claims appended hereto. For example, the values of the height, radius of curvature, and spacing of the cuts may well vary on the size of the carton.

I claim:

1. In a clamshell type container having a top cover portion, a bottom tray portion and an integral back panel, wherein said cover portion and said tray portion are hingedly connected through a hinge line extending across said back panel, the improvement comprising:

a first cut along said hinge line;

a second cut in said back panel positioned to one side of said first cut, wherein said second cut is a continuous curve having a first end point located in said back panel and a second end point intersecting said first cut.

2. The clamshell type container of claim 1, wherein said second cut comprises a negative slope.

3. The clamshell type container of claim 1, wherein said second cut comprises a negative slope throughout its length from said first end point to said second end point.

4. The clamshell type container of claim 1, wherein said first cut is continuous.

5. The clamshell type container of claim 4, wherein said first cut has a length of approximately three fourths of the length of said hinge line.

6. The clamshell type container of claim 4, wherein said first cut is centrally located with respect to said hinge line.

7. The clamshell type container of claim 1, comprising a third cut in said back panel and above said hinge line.

8. The clamshell type container of claim 7, wherein said third cut is a mirror image of said second cut with respect to a line which is perpendicular to said hinge line.

9. The clamshell type container of claim 2, comprising a third cut in said back panel and above said hinge line.

10. The clamshell type container of claim 9, wherein said third cut is a mirror image of said second cut with respect to a line perpendicular to said hinge line.

11. The clamshell type container of claim 3, comprising a third cut in said back panel and above said hinge line.

12. The clamshell type container of claim 11, wherein said third cut is a mirror image of said second cut with respect to a line perpendicular to said hinge line.

13. The clamshell type container of claim 1, comprising a third cut in said back panel and below said hinge line, wherein said third cut is a mirror image of said second cut with respect to said hinge line.

14. The clamshell type container of claim 2, comprising a third cut in said back panel and below said hinge line, wherein said third cut is a mirror image of said second cut with respect to said hinge line.

15. The clamshell type container of claim 3, comprising a third cut in said back panel and below said hinge line, wherein said third cut is a mirror image of said second cut with respect to said hinge line.

16. The clamshell type container of claim 8, wherein said perpendicular line bisects said hinge line.

17. The clamshell type container of claim 7, comprising a fourth cut in said back panel and below said hinge line.

18. The clamshell type container of claim 17, wherein said fourth cut is a mirror image of said second cut with respect to said hinge line.

19. The clamshell type container of claim 8, comprising a fourth cut in said back panel and below said hinge line.

20. The clamshell type container of claim 19, wherein said fourth cut is a mirror image of said second cut with respect to said hinge line.

21. The clamshell type container of claim 11, wherein said second and third cuts have a common end point.

22. The clamshell type container of claim 12, wherein said second and third cuts have a common end point.

23. The clamshell type container of claim 18, wherein said second and third cuts have a common end point.

24. The clamshell type container of claim 19, wherein said second and third cuts have a common end point.

25. The clamshell type container of claim 1, comprising a plurality of second cuts.

26. The clamshell type container of claim 25, wherein said plurality of second cuts are evenly spaced from each other.

27. The clamshell type container of claim 7, comprising a plurality of third cuts.

28. The clamshell type container of claim 27, wherein said plurality of third cuts are evenly spaced from each other.

29. The clamshell type container of claim 28, comprising a plurality of second cuts.

30. The clamshell type container of claim 29, wherein said plurality of second cuts are evenly spaced from each other.

31. The clamshell type container of claim 1, wherein said second cut is positioned above said hinge line.

32. In a clamshell type container having a top cover portion, a bottom tray portion and an integral back panel, wherein said cover portion and said tray portion are hingedly connected through a hinge line extending across said back panel, the improvement comprising:

a first cut along said hinge line;

a second cut in said back panel positioned at one side of said first cut, wherein said second cut is J-shaped having curved section and a straight section.

33. The clamshell type container of claim 32, wherein said first cut is continuous.

34. The clamshell type container of claim 32, wherein said first cut has a length of approximately three fourths of the length of said hinge line.

35. The clamshell type container of claim 34, wherein said first cut is centrally located with respect to said hinge line.

36. The clam shell type container of claim 32, wherein said straight section is parallel to said hinge line.

37. The clamshell type container of claim 32, comprising a third cut in said back panel and above said hinge line.

38. The clamshell type container of claim 37, wherein said third cut is a mirror image of said second cut with respect to a line which is perpendicular to said hinge line.

39. The clamshell type container of claim 32, comprising a third cut in said back panel and below said hinge line, wherein said third cut is J-shaped having a straight section and a curved section.

40. The clamshell type container of claim 39, wherein said third cut is offset with respect to said second cut.

41. The clamshell type container of claim 40, comprising a fourth cut which is a mirror image of said third cut with respect to a line which is perpendicular to said hinge line.

42. The clamshell type container of claim 38, wherein said perpendicular line bisects said hinge line.

43. The clamshell type container of claim 32, wherein said second cut is positioned above said hinge line.

44. In a clamshell type container having a top cover portion, a bottom tray portion and an integral back panel, wherein said cover portion and said tray portion are hingedly connected through a hinge line extending across said back panel, the improvement comprising:

a first cut along said hinge line;

a second cut in said back panel positioned at one side of said first cut, wherein said second cut is a continuous curve having a first end point located in said back panel and a second end point intersecting said first cut; and a third cut in said back panel below said first cut and offset with respect to said second cut.

45. The clamshell type container of claim 44, wherein said second cut comprises a negative slope.

46. The clamshell type container of claim 45, wherein said second cut comprises a negative slope throughout its length from said first end point to said second end point.

47. The clamshell type container of claim 44, wherein said first cut is continuous.

48. The clamshell type container of claim 44, wherein said first cut has a length of approximately three fourths of the length of said hinge line.

49. The clamshell type container of claim 48, wherein said first cut is centrally located with respect to said hinge line.

50. The clamshell type container of claim 44, comprising a fourth cut in said back panel and above said hinge line, wherein said fourth cut is a mirror image of said second cut with respect to a line which is perpendicular to said hinge line.

51. The clamshell type container of claim 44, comprising a fourth cut in said back panel and below said hinge line, wherein said third cut is a mirror image of said third cut with respect to a line which is perpendicular to said hinge line.

52. The clamshell type container of claim 44, comprising a plurality of second cuts evenly spaced from each other.

53. The clamshell type container of claim 52, comprising a plurality of third cuts offset from said plurality of second cuts.

54. The clamshell type container of claim 53, wherein said plurality of third cuts are evenly spaced.

* * * * *

UNITED STATES PATENT AND TRADEMARK OFFICE

CERTIFICATE OF CORRECTION

PATENT NO. : 5,332,147
DATED : July 26, 1994
INVENTOR(S) : John F. Sorenson

It is certified that error appears in the above-indentified patent and that said Letters Patent is hereby corrected as shown below:

ON THE TITLE PAGE

In column 1, line 2, under "References Cited U.S. PATENT DOCUMENTS" delete "708,289" and substitute --708,288--.

IN THE CLAIMS

Col. 8

In Claim 32, line 9, after "having" insert --a--.

Signed and Sealed this

Fourth Day of April, 1995

Bruce Lehman

*Attest:*

BRUCE LEHMAN

*Attesting Officer*

*Commissioner of Patents and Trademarks*